US007146878B2

(12) United States Patent
Holland et al.

(10) Patent No.: US 7,146,878 B2
(45) Date of Patent: Dec. 12, 2006

(54) INK CONTAINER OPENER

(75) Inventors: Carl William Holland, Webster, NY (US); Donald E. Snyder, Jr., Spencerport, NY (US); Michael J. VanDerMeid, Livonia, NY (US)

(73) Assignee: Nu-kote International, Inc., Franklin, TN (US)

( * ) Notice: Subject to any disclaimer, the term of this patent is extended or adjusted under 35 U.S.C. 154(b) by 389 days.

(21) Appl. No.: 10/770,994

(22) Filed: Feb. 3, 2004

(65) Prior Publication Data

US 2005/0242111 A1 Nov. 3, 2005

(51) Int. Cl.
*B67B 7/62* (2006.01)
*B26F 3/02* (2006.01)

(52) U.S. Cl. ..... 81/3.37; 225/103

(58) Field of Classification Search ..... 347/86; 81/3.27, 3.37, 3.39, 3.55; 225/93, 96.5, 103; 241/99

See application file for complete search history.

(56) References Cited

U.S. PATENT DOCUMENTS

| | | | | |
|---|---|---|---|---|
| 1,376,994 | A | 5/1921 | Arnold | |
| 2,057,614 | A | 10/1936 | Girard | |
| 2,386,460 | A | 10/1945 | Heim | |
| 2,526,362 | A | 10/1950 | Johnston | |
| 2,554,948 | A | 5/1951 | Kiefer | |
| 2,818,701 | A | 1/1958 | Erkkila | |
| 2,876,665 | A | 3/1959 | Lecours | |
| 3,404,593 | A | 10/1968 | Arcarese et al. | |
| 3,828,976 | A | 8/1974 | Sidelinker | |
| 3,993,220 | A | 11/1976 | Troy | |
| 4,026,262 | A | 5/1977 | Yasuga | |
| 4,171,055 | A | 10/1979 | Lindgren | |
| 4,248,564 | A | 2/1981 | Gentile et al. | |
| 4,378,624 | A | 4/1983 | Klingenberg | |
| 4,708,033 | A | 11/1987 | Eash | |
| 4,768,271 | A | 9/1988 | Jacob et al. | |
| 4,805,821 | A | 2/1989 | Kowalczyk et al. | |
| 4,817,810 | A | 4/1989 | Shull | |
| 5,031,485 | A | 7/1991 | Wu | |
| 5,129,566 | A | 7/1992 | Ogden et al. | |
| 5,199,470 | A | 4/1993 | Goldman | |
| 5,207,125 | A * | 5/1993 | Pierce et al. | 81/3.43 |
| 5,222,265 | A * | 6/1993 | Hermansson | 7/156 |
| 5,295,419 | A | 3/1994 | Denning | |
| 5,537,134 | A | 7/1996 | Baldwin et al. | |
| 5,546,830 | A | 8/1996 | Yuen | |
| 5,551,643 | A | 9/1996 | Chapin | |
| 5,647,251 | A * | 7/1997 | Hardman | 81/3.2 |

(Continued)

FOREIGN PATENT DOCUMENTS

| | | |
|---|---|---|
| WO | WO 97/47475 | 12/1997 |

*Primary Examiner*—Anh T. N. Vo
(74) *Attorney, Agent, or Firm*—Fay, Sharpe, Fagan, Minnich & McKee, LLP

(57) ABSTRACT

An ink container opener has a base member having an opening for receiving a cap of an ink container and a holder member which is inserted over a body of the ink container. The holder and base member each has a first arm and a second arm substantially perpendicular to said first arm. The holder member first arm has an opening for receiving a second portion of the ink container. The base member opening and the holder member opening are substantially parallel to each other when the ink container is mounted within the opener. Force is applied to the holder member to separate the cap from the ink container body.

15 Claims, 2 Drawing Sheets

U.S. PATENT DOCUMENTS

| | | | | |
|---|---|---|---|---|
| 5,657,678 | A | 8/1997 | Cohen | |
| 5,704,403 | A | 1/1998 | Schwenk et al. | |
| 5,838,352 | A | 11/1998 | Martinez | |
| 5,845,682 | A | 12/1998 | Hayao | |
| 5,906,143 | A | 5/1999 | Yuen | |
| 6,053,604 | A | 4/2000 | Sato et al. | |
| 6,116,724 | A | 9/2000 | Bursese | |
| D437,534 | S | 2/2001 | Gloden | |
| 6,393,947 | B1 * | 5/2002 | Corcoran et al. | 81/3.31 |

* cited by examiner

INK CONTAINER OPENER

The invention relates to an ink container opener. More particularly, it relates to an ink container opener for removing a cap from a body of an ink container used in ink jet printing.

BACKGROUND OF THE INVENTION

An ink container typically includes a container body and a container cap. The cap is usually ultrasonically welded, glued or heat staked to the body after the container has been filled with ink during initial manufacturing. Once the ink has been depleted from the container, the container can be reused by refilling it with ink. To assist in refilling the ink container, the user usually either removes the cap or drills holes into the cap to provide access into the interior of the container so that ink can be added. At times the ink container cap may be fabricated of a rigid plastic material that is difficult to penetrate using a hand-held drill bit which is typically supplied with ink refill kits. Thus, drilling holes into the cap can be difficult for the user, especially for a color container where three holes are required.

Accordingly, there is a need for a means for easily removing the cap from an ink supply container to enable the addition of more ink, thereby extending the useful life of the container. Thus, there is a need for an ink container opener that allows the consumer or user to remove the container cap without drilling holes into the cap. The present invention includes a container opener which enables the consumer to remove the container cap using two L-shaped members. A first member or a base member holds the cap of the container and a second member or force applicator slips over the container body. The user pushes down and exerts force onto an end of the force applicator with the palm of his or her hand. This downward force then enables the cap to be disconnected or separated from the body. The force applicator provides a higher mechanical advantage than would be achieved by applying force directly to the container body. This is particularly advantageous for use on containers with very rigid joints between the cap and the body or with smaller container bodies. An example of such a container is the Hewlett Packard HP51649 container.

SUMMARY OF THE INVENTION

The present invention relates to an ink container opener. More particularly, it relates to an ink container member having a base member and a separate force application member for separating a cap from an ink container.

More particularly, an ink container opener has a base member having an opening for receiving a first portion of an ink container. A holder member is inserted over a second portion of the ink container. The holder member has a first member and a second member substantially perpendicular to the first member. The base member also has a first member and a second member substantially perpendicular to the base member first member. The base and holder members are each substantially L-shaped. The holder member first member has an opening for receiving a second portion of the ink container. The base member and holder member openings are substantially parallel to each other when the ink container is mounted within the opener.

A plurality of reinforcement members are interposed between the holder member first member and the holder member second member. The base member further has a plurality of reinforcement members interposed between the first and second members. The reinforcement member can be triangular in shape.

The base member second member extends along a longitudinal axis of the ink container when the ink container is mounted within the opener. The base member opening and the holder member opening are each rectangular in shape.

Gripping members are provided on the holder member for manually gripping the holder member. The base member can have a support surface for supporting the ink container opener when force is applied to the holder member. When the ink container is installed within the opener, the base member and holder member second members are substantially parallel to each other.

One aspect of the present invention is a two-piece ink container opener which allows a user to apply force to the opener by body weight in addition to hands and arms.

Another aspect of the invention is that the container opener has a base member which rests on a work surface to absorb applied force, thereby enabling the user to apply one-handed operation.

Another aspect of the invention is that the container opener can be placed on a floor and the ball of a user's foot can be used to apply force to the opener if the user has weak hands and arms or if the attachment of the cap is so strong as to make it difficult or impossible to remove the cap using hand force.

Another aspect of the invention is that the two-piece container opener has a mechanical advantage that can be varied by adjusting the length of the force applicator which acts as a lever.

Yet another aspect of the invention is the L-shaped configuration of the holder member and base member which provides storage and space efficiencies.

Still other aspects and advantages of the invention will become apparent to those skilled in the art upon a reading and understanding of the following detailed description.

BRIEF DESCRIPTION OF THE DRAWINGS

The invention may take form in certain components and structures, a preferred embodiment of which is illustrated in the accompanying drawings wherein.

DETAILED DESCRIPTION OF PREFERRED EMBODIMENTS

Figure 1:
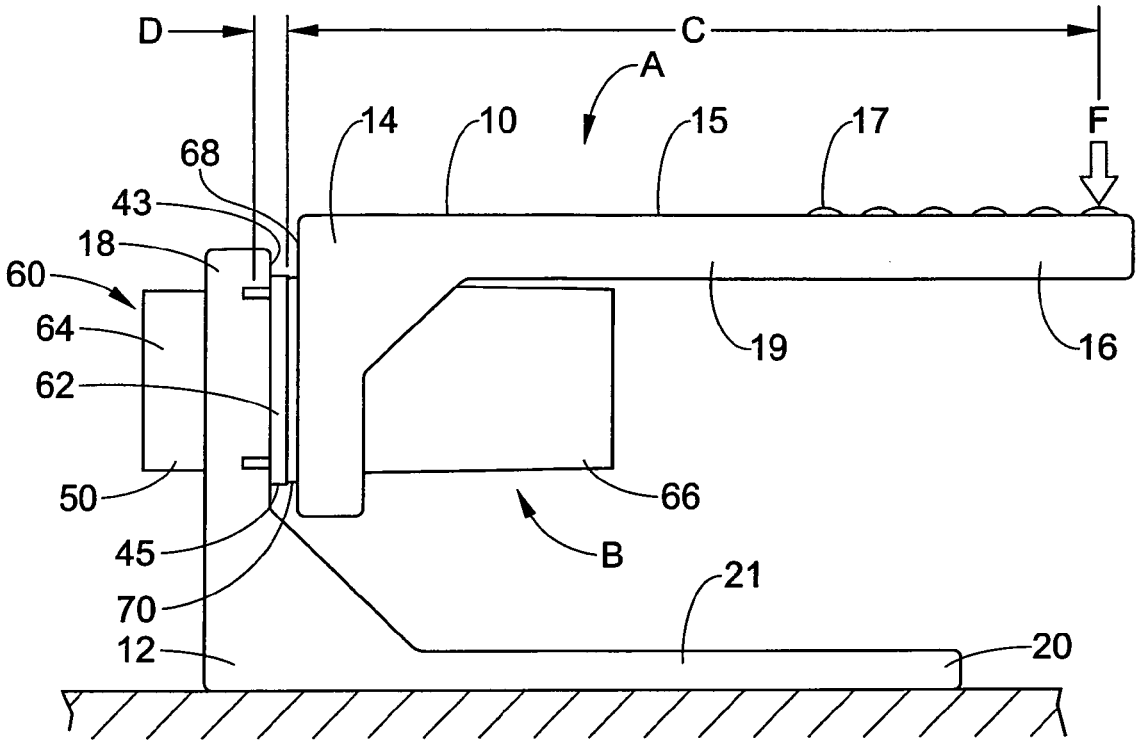
FIG. 1 is a side elevational view of a two-piece ink container opener with an ink container mounted within the opener in accordance with a preferred embodiment of the present invention.

Referring to FIG. 1, the ink container opener A has a first member or a force applicator 10 and a separate second member or base member 12. The two members together selectively hold an ink container B for removing a cap from the container. An example of such an ink container is the Hewlett Packard HP51649 container.

Figure 4:
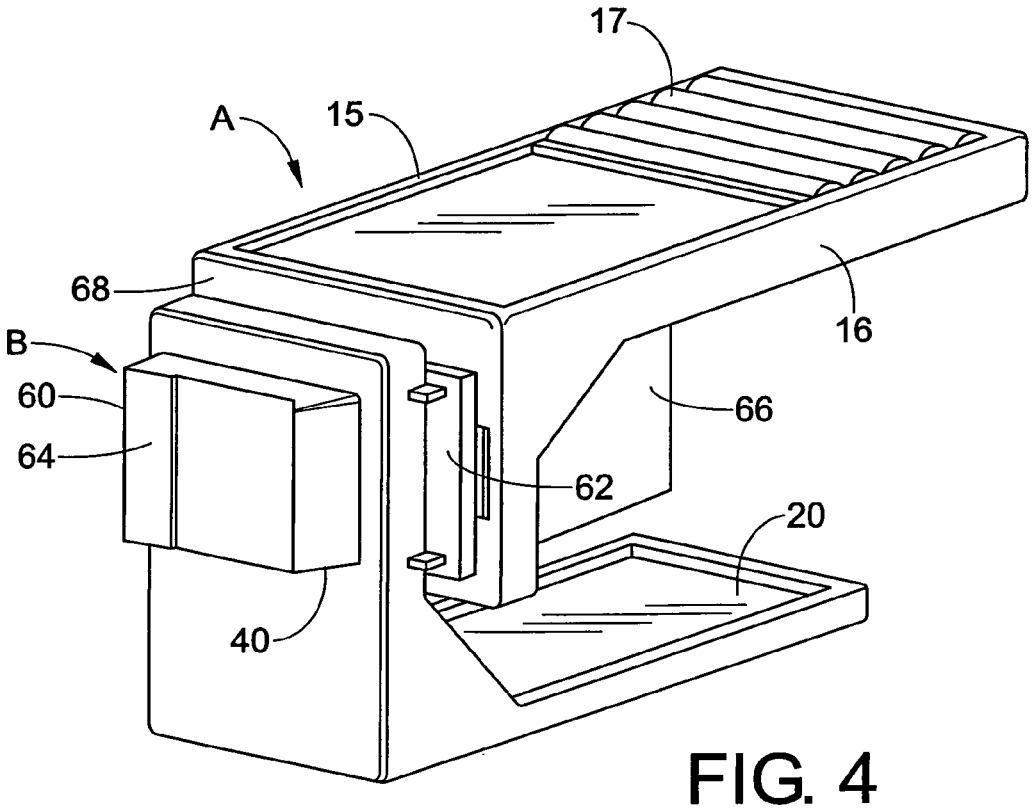
FIG. 4 is a perpective view of the assembled ink container opener of FIG. 1 with an ink container mounted therein.

The force applicator has a first arm 14 and a second arm 16. Each arm is substantially rectangular in shape and has generally flat surfaces. The force applicator further has a first surface 15 on second arm 16 from which several gripping portions or ridges 17 protrude. Referring to FIG. 4, the ridges 17 are parallel to each other and are approximately equally spaced apart. The ridges are shown as being rectangular in shape; however, other shapes and configurations are also contemplated by the present invention. The gripping members are used by the user to facilitate manually gripping and applying a lateral force to the container opener.

Figure 2:
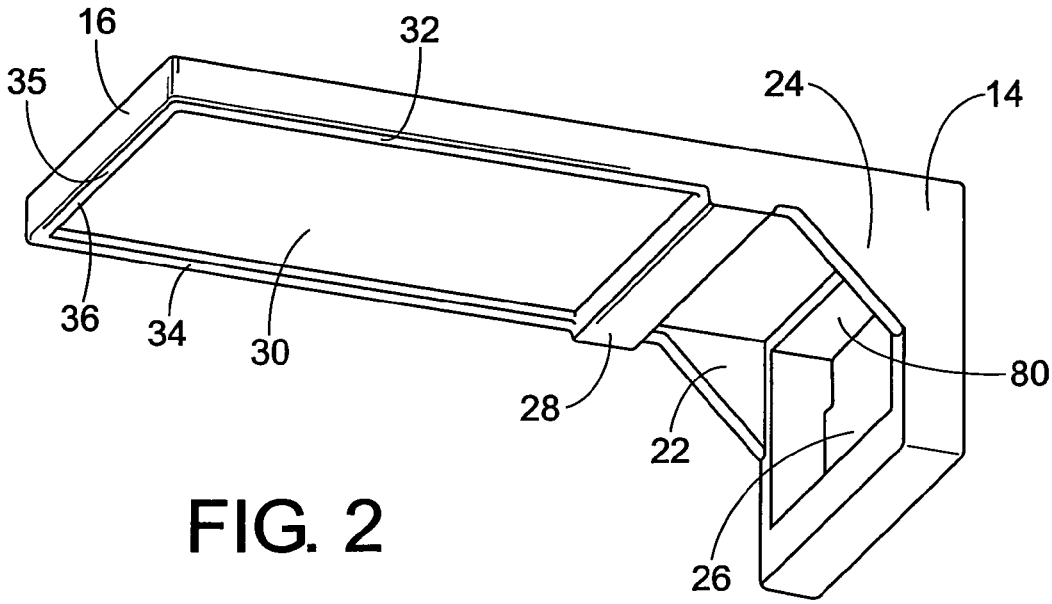
FIG. 2 is a perspective view of a force applicator of the ink container opener of FIG. 1.

Referring now to FIG. 2, the force applicator is substantially L-shaped with arms 14 and 16 approximately perpendicular to each other. The force applicator is preferably formed of a unitary construction from metal, or another suitable material. A pair of reinforcement members 22, 24 extend between the arms 14, 16. The reinforcement members are to provide additional rigidity and strength to the force applicator. As seen in FIG. 2, the reinforcement members are substantially triangular in shape and are of a unitary construction with arms 14, 16.

A substantially rectangular opening 26 is provided in first arm 14 to receive and hold a cap of ink container B. A raised member or ridge 28 is formed on a surface 30 of the second portion 16. The raised member extends laterally from one edge 32 to an opposite edge 34 of the second arm. The ridge or rib is rectangular in shape; however, other shapes or configurations are also contemplated by the present invention. The raised member 28 is used to provide lateral support to the ink container body. Raised portions 36 are further provided around the edges 32, 34, 35 of the force applicator to provide additional rigidity and strength to the force applicator.

Figure 3:
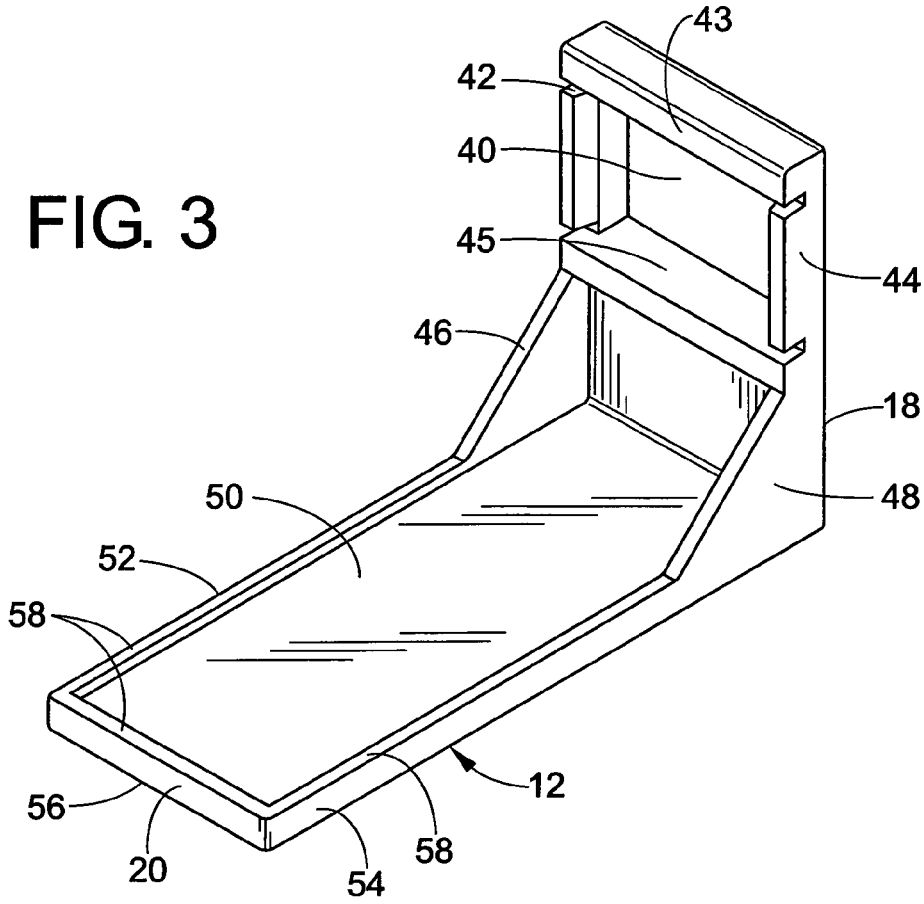
FIG. 3 is a perspective view of a base member of the ink container opener of FIG. 1.

Referring now to FIG. 3, the base member 12 also has a first arm 18 and a second arm 20 which are approximately perpendicular to each other and are formed in a substantially L-shaped configuration. Each arm is substantially rectangular in shape and has generally flat surfaces; First portion 18 also has an opening 40 which is substantially rectangular in configuration and is formed by sidewalls 42, 43, 44, 45. Walls 42 and 44, which are parallel to each other, are used to support the body of the ink container when it is received by the container opener. Walls 43, 45 extend between walls 42, 44 and are parallel to each other. Walls 42, 44 have edges which extend beyond edges of walls 43, 45 which provide additional support for a cap of an ink container.

Reinforcement members 46, 48 are provided between first arm 18 and second arm 20 to provide additional rigidity to the connection between the first and second arms. The reinforcement members are shown to be of unitary construction with the first and second arms. The reinforcement members are shown to be of an angled or triangular configuration. However, other configurations are also contemplated by the present invention. The second arm 20 has a surface 50 from which extends ribs or ridges 58 along edges 52, 54, 56 to provide additional rigidity to surface 50.

Referring now to FIG. 4, and as will be appreciated from FIG. 1, the second arm 20 of the base member is shorter in length than the second arm 16 of the force applicator. The force applicator provides a higher mechanical advantage than could be achieved by the user pressing directly on the container body. As seen in FIG. 1, the mechanical advantage of the two-piece opener is calculated by the distance from the force application point to the cap and body joint of the container (distance "C") divided by the distance from the cap support point to the cap and body joint (distance "D"). Thus, in FIG. 1, distance C is divided by distance D which results in a mechanical advantage of approximately 25. This type of mechanical advantage results for a container such as the Hewlett Packard HP51649 container. The mechanical advantage can be altered by either increasing or decreasing the length of arm 16 of the force applicator or by moving the force applicator to various positions on the body 66 of the ink container.

The operation of removing an ink container cap using the container opener will now be discussed.

The container opener enables a user to separate and remove an ink container cap from an ink container body by using two substantially L-shaped parts; namely, the base member and force applicator. The base member is used to hold the cap of the container in place when the force is applied. The force applicator slips over the container body. Referring to FIG. 4, ink container cap 60 is inserted into opening 40 of the base member. Portion 62 of the cap abuts surfaces 43, 45 (see FIG. 3) of the first portion 18 of the base member and holds the cap in place within opening 40. Portion 64 of the cap protrudes through opening 40.

The force applicator is then inserted over the body 66 of the ink container by inserting the container body through opening 26. The force applicator is slid until surface 68 of first arm 14 abuts a surface 70 (FIG. 1) of body 66 and prevents any further lateral movement of the force applicator with respect to the ink container body.

Referring now to FIG. 1, when the container is positioned within the opener assembly, the openings of the force applicator and base member are substantially parallel to each other and are aligned together. Similarly, the force applicator second arm 16 and the base member second arm 20 are substantially parallel to each other. As can be seen in FIG. 1, the force applicator second arm 16 has a dimension longer along the longitudinal axis than the second arm 20 of the base member. Referring to FIG. 1, the force applicator and base member are aligned such that inner surfaces 19, 21 face each other in the assembled configuration.

A mechanical advantage is achieved by the length of the second portion of the force applicator. Dimension C is the dimension from the point where force F is applied to the applicator to the joint connecting the cap to the body of the container. Dimension D is the distance between the point of support for the cap provided by the first portion 18 of the base member and the joint formed between the cap and the container. The point where the force is applied to the force applicator is indicated by arrow F. The mechanical advantage (distance C divided by distance D) is approximately 25 for a container such as a Hewlett Packard HP51649 container. That is, the force exerted on the container is increased 25 times due to the moment arm formed by the force applicator.

Force is then manually applied to force applicator arm 16 and in a downward manner thus bringing a wall 80 (see FIG. 2) of the opening 26 in the first arm 14 of the holder member into contact with the surface 70 of the container body and disconnecting or separating the joint of the cap from the container body, thus breaking off the cap from the body. The cap is retained within the opening of first arm 18 of the base member. The cap and container body are then removed from the opener assembly. To assist in applying the force to the container body, the base member can be placed onto a work surface such as a table or desk as shown in FIG. 1. If the user has particularly weak hands or arms, or if the bond of the cap is very strong, the opener can be placed onto a floor surface, and the ball of a foot could also be used to apply the force to the force applicator.

Alternatively, the user could pull the force applicator in an upward direction (in FIG. 1) and push downwardly on the base member to separate the cap from the container body.

Once the cap is removed, additional ink may be added to the container. A new cap may be welded or otherwise secured to the container.

The L-shaped configuration of the base member and the force applicator enable the container opener to be space efficient. That is, the two pieces can be placed at opposite corners of a refill kit container to surround the other refill kit contents or the two pieces could be nested one inside the other and at one particular corner of a kit. This results in only a small increase in the volume of the ink refill kit for storage and shipping purposes.

The invention has been described with reference to a preferred embodiment. Obviously, alterations and modifications will occur to others upon a reading and understanding of this specification. The invention is intended to include all such modifications and alterations insofar as they come within the scope of the appended claims or the equivalents thereof.

Having thus described the preferred embodiment, the invention is now claimed to be:

1. An ink container opener, comprising:

a base member having an opening for receiving a first portion of an ink container; and a holder member which is inserted over a second portion of said ink container, said holder member has a first arm and a second arm substantially perpendicular to said first arm, said base member has a first arm and a second arm substantially perpendicular to said base member first arm, wherein said holder member first arm has an opening for receiving a second portion of said ink container, wherein said base member opening and said holder member opening are substantially parallel to each other when said ink container is mounted within said opener.

2. The ink container opener of claim 1, wherein said holder member further comprises a plurality of reinforcement members interposed between said holder member first arm and said holder member second arm.

3. The ink container opener of claim 2, wherein said reinforcement members are substantially triangular in shape.

4. The ink container opener of claim 1, wherein said base member further comprises a plurality of reinforcement members interposed between said base member first arm and said base member second arm.

5. The ink container opener of claim 4, wherein said reinforcement members are substantially triangular in shape.

6. The ink container opener of claim 1, wherein said base member second arm extends along a longitudinal axis of said ink container when said ink container is mounted within said opener.

7. The ink container opener of claim 1, wherein said base member opening and said holder member opening are each substantially rectangular in shape.

8. The ink container opener of claim 1, wherein said holder member second arm further comprises a plurality of gripping members for manually gripping said holder member.

9. The ink container opener of claim 1, wherein said holder member further comprises a raised member extending along a lateral axis of said holder member second arm, said raised member supports said second portion of said ink container.

10. The ink container opener of claim 1, wherein said base member is substantially L-shaped.

11. The ink container opener of claim 1, wherein said holder member is substantially L-shaped.

12. The ink container opener of claim 1, wherein said base member comprises a support surface for supporting said ink container opener when force is applied to said holder member.

13. The ink container opener of claim 1, wherein when said ink container is installed within said opener, said base member second arm and said holder member second arm are substantially parallel to each other.

14. A method of opening an ink container, comprising the steps of:

placing a first arm of an ink container opener base member onto a support surface;

inserting a first portion of an ink container into an opening of a second arm of said ink container opener base member, wherein said first and second arms are substantially perpendicular to each other;

inserting a second portion of said ink container through an opening of a first arm of an ink container opener holder member;

applying a lateral force to a second arm of said holder member, wherein said holder member second arm is substantially perpendicular to said holder member first arm;

separating said first portion of said ink container from said second portion of said ink container through the application of the lateral force.

15. The method of claim 14, wherein said opening of said base member second arm and said opening of said holder member first arm are aligned to be substantially parallel to each other after the first and second portions of the ink containers are inserted into the openings.

* * * * *